United States Patent [19]

Magee, Jr.

[11] Patent Number: 4,493,374

[45] Date of Patent: Jan. 15, 1985

[54] HYDRAULIC SETTING TOOL

[75] Inventor: Robert L. Magee, Jr., Fort Worth, Tex.

[73] Assignee: Arlington Automatics, Inc., Grand Prairie, Tex.

[21] Appl. No.: 478,360

[22] Filed: Mar. 24, 1983

[51] Int. Cl.[3] ..... E21B 23/06; E21B 33/129

[52] U.S. Cl. ..... 166/382; 166/383; 166/387; 166/106; 166/120

[58] Field of Search ..... 166/381, 382, 383, 387, 166/106, 212, 217, 120, 122, 123, 181, 182, 187, 196

[56] References Cited

U.S. PATENT DOCUMENTS

| | | | |
|---|---|---|---|
| 2,831,540 | 4/1958 | Huber | 166/123 |
| 3,057,406 | 9/1962 | Patterson et al. | 166/123 |
| 3,125,162 | 3/1964 | Briggs, Jr. et al. | 166/123 |
| 3,160,209 | 12/1964 | Bonner | 166/63 |
| 3,186,485 | 6/1965 | Owen | 166/122 |
| 3,294,171 | 12/1966 | Kelley | 166/123 |
| 3,298,437 | 1/1967 | Conrad | 166/63 |
| 3,306,362 | 2/1967 | Urbanosky | 166/135 |

*Primary Examiner*—Stephen J. Novosad
*Assistant Examiner*—William P. Neuder
*Attorney, Agent, or Firm*—James E. Bradley

[57] ABSTRACT

A hydraulic setting tool is shown of the type used to set a downhole device in a well bore. The setting tool includes an elongated tubular body adapted to be supported from a wireline within the well bore. The body has an outer sleeve portion and an inner piston portion slidably received within the sleeve portion. The inner piston portion and the outer sleeve portion are engagable with a device to be set whereby opposite relative movement of the piston portion and the sleeve portion acts to set the device. An electric motor is carried within the tubular body and is connected through the wireline with a source of electric power at the well surface. A hydraulic pump is carried within the tubular body having a fluid intake and a fluid output and is coupled to the electric motor to be driven thereby. A fluid passage communicates the hydraulic pump fluid output with the body inner piston portion for supplying pressurized hydraulic fluid to the inner piston portion to move the inner piston portion relative to the outer sleeve portion and thereby set the downhole device.

10 Claims, 7 Drawing Figures

11
15
17
19
49
13
45
33
31
23
21
35
37
41
53
51
43
39
91
25
57
61
27
63
29

29
69
65
67
59
93
79
73
95
75
71
81
85
83
87
99
101
103
105
77
97
107
109
119
121
117
125
123
115
129
131
111
127
133
135
113

165
155
185
159
161
235
191
233
219
195
223
193
225
205
221
207
217
203
213

HYDRAULIC SETTING TOOL

BACKGROUND OF THE INVENTION

The present invention relates generally to well tools of the type used to set downhole devices in a well bore and, specifically, to a wireline setting tool which is hydraulically actuated.

Various types of wireline setting tools are known in the art for setting downhole devices in a well bore. Such setting tools are engaged with the device to be set at the well surface and lowered to the desired setting depth within the well bore on a wireline or cable. Wireline setting tools have, in the past, generally utilized an explosive charge or bomb which was detonated by an electrical signal from the well surface and passed through the wireline to the firing chamber of the setting tool. The gases generated by ignition of the charge were used to compress a fluid such as oil, which, in turn, was used to drive a piston member. In certain of the prior art devices, the piston member was connected through a cross-link to an outer sleeve member which was disposed about an inner cooperating tubular member. Upon actuation of the charge, the outer sleeve and cooperating inner tubular member moved in opposite relative directions to effect the setting of a suitably engaged device such as a bridge plug, packer, or the like in the well bore.

There are many disadvantages inherent in the use of a setting tool which is actuated by an explosive charge. Explosives are dangerous to handle and difficult to store and maintain on the job site. Special permits and licenses are often required to comply with State and local safety regulations. Another problem associated with the use of explosive actuation is the necessity of providing a controlled, gradual setting action on the device to be set. Certain of the prior setting tools have included an orifice in the body of the tool through which oil is forced as detonation occurs to thereby slow the setting action on the device being set. Also, explosive charges which are "slow burning" are employed in order to lessen the undesirable effects of a sudden explosion. The use of an explosive charge also requires that the firing chamber of the tool be cleaned regularly between uses thereby adding to the maintenance requirements of the tool.

There exists a need, therefore, for a wireline setting tool which provides a gradual controlled setting action for setting downhole devices in a well bore.

There exists a need for such a device which does not require explosives and which can be reused without the attendant cleanup of an explosive actuated tool.

SUMMARY OF THE INVENTION

The setting tool of the present invention is used to set downhole devices in a well bore. The setting tool has an elongated tubular body having an outer sleeve portion and an inner piston portion slidably received within the sleeve portion. The inner piston portion and outer sleeve portion are engagable with the device to be set in a suitable fashion whereby opposite relative movement of the piston portion and the sleeve portion serves to set the device. Hydraulic pump means carried within the tubular body are provided for supplying pressurized hydraulic fluid to the inner piston portion of the setting tool to move the inner piston portion relative to the outer sleeve portion and thereby set the downhole device.

Preferably, the elongated tubular body is adapted to be supported from a wireline within the well bore. An electric motor is carried within the tubular body and is connected through the wireline with a source of electric power at the well surface. The electric motor has an output shaft which is used to drive a hydraulic pump carried within the tubular body having a fluid intake and fluid output. Fluid passages communicate the hydraulic pump fluid output with the body inner piston portion for supplying pressurized hydraulic fluid to the inner piston portion to move the inner piston portion relative to the outer sleeve portion and thereby set the downhole device.

The inner piston portion engages the device to be set by means of a frangible connection. Movement of the inner piston portion relative to the outer sleeve member serves to sever the frangible connection at a predetermined shear force to thereby release the setting tool from the set downhole device to allow the setting tool to be retrieved to the well surface.

In the method of the invention, the device to be set is engaged with the setting tool and the setting tool and device are lowered on a wireline to the desired setting depth within the well bore. Hydraulic fluid pressure is then gradually supplied to the inner piston portion of the setting tool to move the inner piston portion relative to the outer sleeve portion to set the downhole device. Additional hydraulic fluid pressure is then supplied to the inner piston portion to separate the setting tool from the device. The setting tool is then retrieved to the well surface.

Additional objects, features and advantages will be apparent in the written description which follows.

DETAILED DESCRIPTION OF THE INVENTION

Figure 1A:
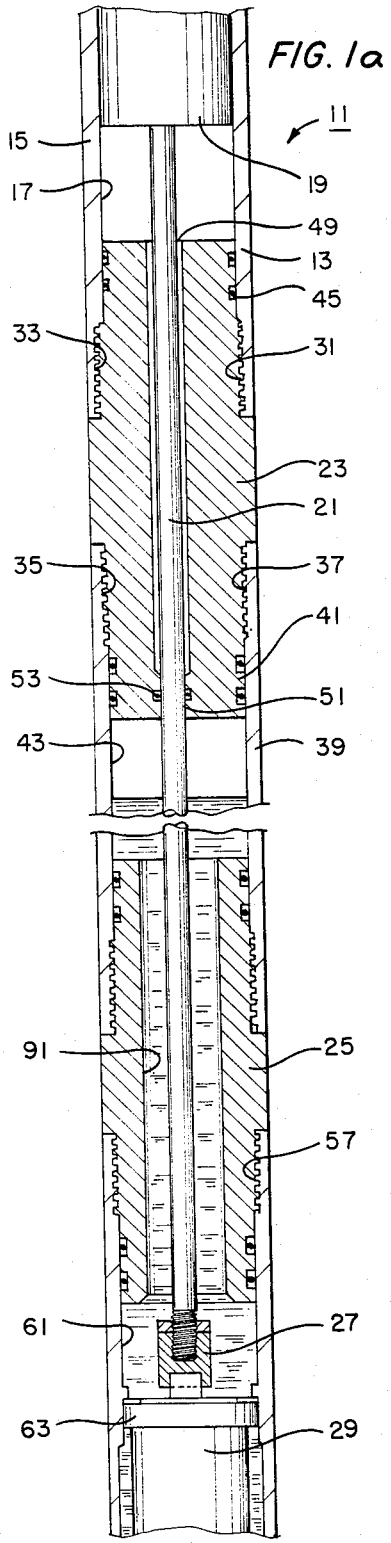
FIG. 1A is a side cross-sectional view of a setting tool of the invention showing the upper end thereof.

Turning now to FIG's. 1A–1D, there is shown a setting tool of the invention designated generally as 11. The setting tool 11 has an elongated tubular body 13 which is comprised of a plurality of threadedly engaged segments as will be presently described. The upper segment (15 in FIG. 1A) is a generally cylindrical tubular member having a bore 17 and an upper end with a suitable attachment for a wireline (not shown) which extends to the well surface.

An electric motor 19 is carried within the tubular body 13 and is connected through the wireline with a conventional source of electric power (not shown) at the well surface. The motor 19 has an output shaft 21 which passes through an upper bushing 23 and a lower bushing 25 and which is connected by means of a coupling 27 to a hydraulic pump 29 for driving the pump.

As seen in FIG. 1A, the upper bushing 23 is a generally solid piece having an externally threaded upper surface 31 for matingly engaging the internally threaded lower end 33 of the upper segment 15 and having a lower externally threaded surface 35 which matingly engages the internally threaded surface 37 of an intermediate segment 39 of the tubular body 13. The outer surface 41 of the upper bushing 23 forms a fluid seal with the bore 17 and a corresponding bore 43 of segment 39 by means of suitably placed O-ring seals 45.

Bushing 23 also has a central opening 47 for receiving the motor output shaft 21 which opening decreases in internal diameter from the upper end 49 thereof to the lower end 51. Lower end 51 includes an O-ring 53 which is received within an O-ring groove provided within the sidewalls of the opening 47 adjacent the lower end 51.

As shown in FIG's. 1A and 1B, the lower bushing 25 has an externally threaded surface 55 for matingly engaging an internally threaded surface 57 of a lower segment 59 of the tubular body 13. Lower segment 59 includes a tubular bore 61 similar to bores 17, 43 and includes a mounting shoulder 63 for mounting the hydraulic pump 29.

The hydraulic pump 29 is a positive displacement radial piston pump or swash plate pump of the type known in the art. The pump 29 is carried within the tubular body 13 as shown in FIG. 1A and has a conventional fluid intake and a fluid output (65 in FIG. 1B). Fluid output 65 is connected to an end bushing 67 by means of a threaded nipple 69 whereby the fluid output of the pump 29 passes from the nipple 69 through a central opening 71 in the end bushing 67.

The end bushing 67 includes an externally threaded surface 73 which matingly engages an internally threaded surface 75 of a connecting sub 77. Connecting sub 77 is a generally solid piece having an upper opening 79 for receiving the end bushing 67 and a stepped region 81 which conforms to the external dimensions of the end bushing 67. The lower extent 83 of the end bushing 67 sealingly engages the stepped region 81 by means of suitably placed O-rings 85 whereby central opening 71 communicates the pump fluid output 65 with a recess 87 in the opening 79 of the connecting sub 77.

As can be seen in FIG's. 1A and 1B, hydraulic fluid 89 within the bore 43 communicates through the central opening 91 in lower bushing 25 with the bore 61 and is free to pass through openings in the mounting shoulder 63 of the pump 29 to the space 93 below the pump 29 which communicates the hydraulic fluid to the pump fluid intake (not shown). The O-ring seals 85, 95, provide a fluid seal between the space 93 and a passage 97 in the connecting sub 77.

Figure 1B:
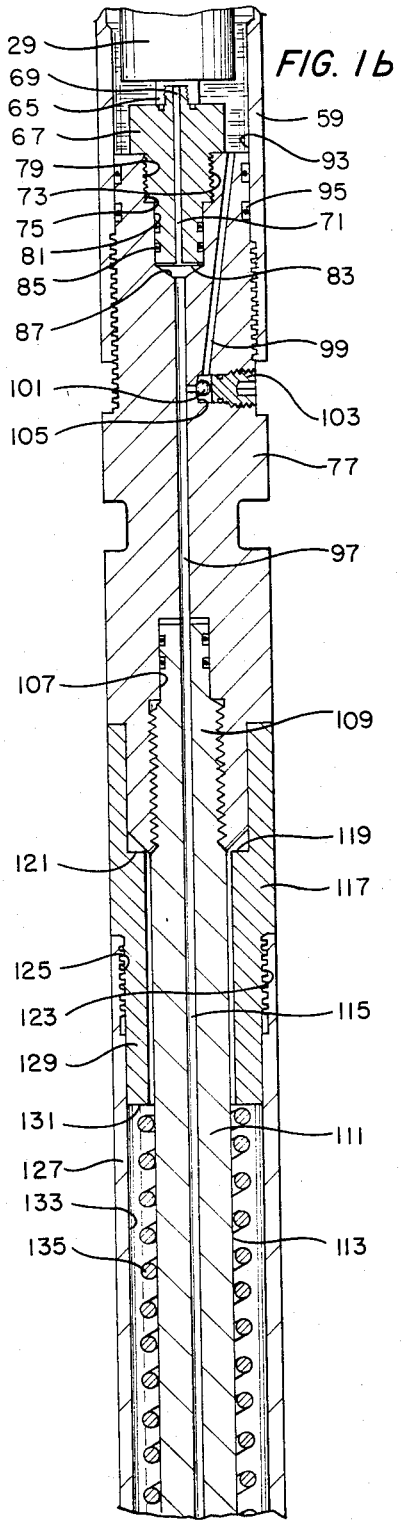
FIG. 1B is a downward continuation of FIG. 1A showing the tool in the position to be run into the well bore.

Connecting sub 77 is provided with a side passage 99 which communicates with the space 93 below the pump 29 but which is blocked off in the view shown in FIG. 1B by the ball bearing 101 and threaded plug 103 which are received within a portion 105 of the side passage 99.

The lower end of the connecting sub 77 includes a recess 107 adapted to receive the upper threaded extent 109 of a piston portion 111 of the setting tool 11. The piston portion 111 includes an upper longitudinal extent 113 which includes a central passage 115 which communicates with the passage 97 in the connecting sub 77.

A separating sub 117 surrounds the piston portion 111 adjacent the upper threaded extent 109 and includes an internal shoulder 119 adapted to slidingly receive a downwardly extending portion 121 of the connecting sub 77. Separating sub 117 includes an outer threaded surface 123 adapted to matingly engage an internally threaded surface 125 of a tubular spring sleeve 127. The lower extent 129 of the separating sub 117 forms an internal shoulder 131 within the bore 133 of the spring sleeve 127 and forms an upper spring stop for a coil spring 135 which is received about the exterior of the piston portion 111 as shown in FIG's. 1B–1C.

Figure 1C:
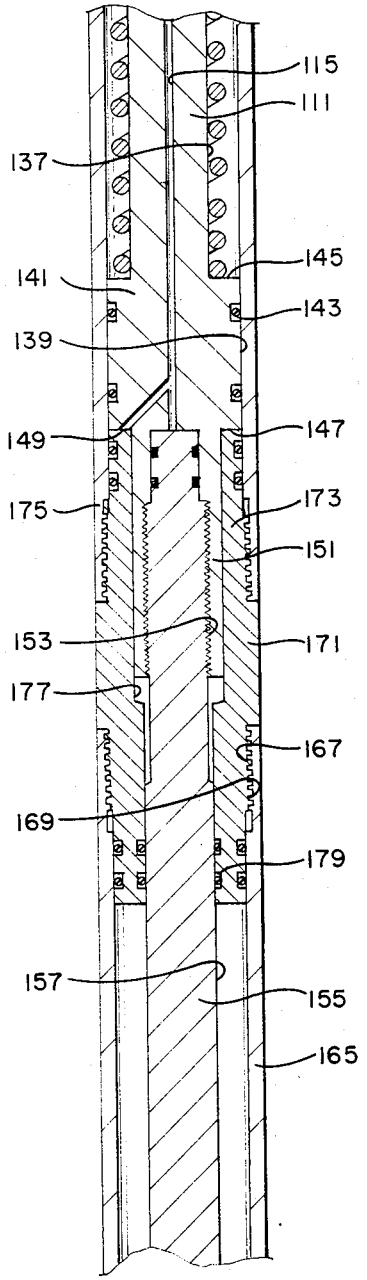
FIG. 1C is a downward continuation of FIG. 1B.

As shown in FIG. 1C, the piston portion 111 includes a region of reduced external diameter 137 which is joined to a region of greater relative diameter 139 to form a piston area 141 which sealingly engages the bore 133 by means of suitable O-rings 143. Piston area 141 includes an inner face region 145 which forms a lower spring stop for the coil spring 135 and an outer face region 147. The central passage 115 in the piston portion 111 communicates by means of an end opening 149 with the bore 133 of the spring sleeve 127 below the piston area 141.

The piston portion 111, as shown in FIG. 1C, includes an internally threaded depending portion 151 which threadedly engages an externally threaded end 153 of the piston portion lower extent 155. Lower extent 155 includes a region of reduced external diameter 157 which is joined to a region of increased external diameter 159 to form a lower piston area 161. The lower piston 161 is slidably received within the bore 163 of a tubular member 165. Tubular member 165 has an upper internally threaded end 167 which threadedly engages the lower threaded end 169 of a piston sub 171 whose upper threaded end 173 engages the lower threaded end 175 of spring sleeve 127.

The piston portion lower extent 155 slides within a stepped bore 177 within piston sub 171. Bore 177, as shown in FIG. 1C, is sealed off from bore 163 by means of suitable O-ring seals 179. Bore 163 is sealed off at the lower end thereof by the sealing engagement of suitable O-rings 181 provided in the external diameter of the lower piston area 161. The lower piston area 161 is also provided with a fluid passageway 183 which communicates by means of a side passage 185 with the bore 163. Fluid passageway 183 is sealed off in the view shown in FIG. 1D by means of a ball bearing 187 and threaded plug 189 which are received within an end opening 191 in the lower piston area 161.

Figure 1D:
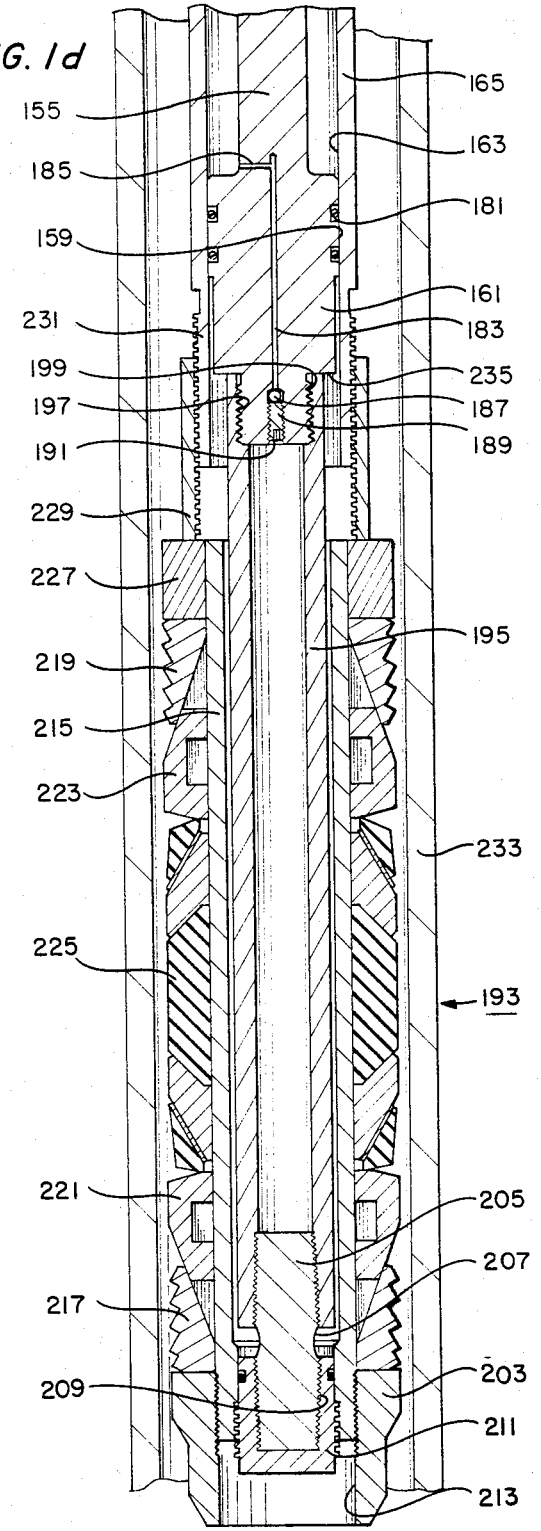
FIG. 1D is a downward continuation of FIG. 1C showing in the lower end of the tool in the position to be run into the well bore.

As shown in FIG. 1D, the setting tool 11 is engagable with a downhole device to be set designated generally as 193. The device to be set 193 can be any of the conventional downhole devices which is set by opposite relative movement of an outer sleeve portion and inner cooperating tubular or piston portion of a wireline setting tool. The device 193 illustrated in FIG. 1D is a bridge plug device, although it will be appreciated that other devices such as well packers and the like can be used. The device 193 is carried about a lower tubular extent 195 of the setting tool piston portion 111 which has an internally threaded upper end 197 adapted to engage an externally threaded surface 199 of the piston portion 111 of the setting tool 11. Alternatively, an intermediate adapter coupling can be used. The lower tubular extent 195 has an internally threaded end 201 which is adapted to be connected to an end sub 203 of the device to be set by means of a frangible connection 205. The frangible connection 205 is a generally solid member having a central region 207 of weakened construction. The frangible connection 205 has a lower threaded extent 209 opposite threaded end 201 which threadedly engages a connecting ring 211 which is threadedly engaged within the bore 213 of the end sub 203.

The device to be set 193 has an inner tubular body 215 which threadedly engages the connecting ring 211 and which supports gripping slips 217 and 219 along with their associated expanders 221, 223 and a central elastomeric seal portion 225. A setting ring 227 is carried about the upper end of the tubular body 215 and is suitably positioned to be acted upon by a setting sleeve 229 which threadedly engages the depending sleeve portion 231 of tubular member 165. It will be appreciated from FIG. 1D by those skilled in the art that while the inner tubular body 215 and end sub 203 are held in fixed position by frangible connection 205 that downward movement of setting sleeve 229 will act through setting ring 227 to cause outward radial movement of the gripping slips 217 and 219 and outward radial movement of the seal portion 225 in the direction of the well casing 233.

The operation of the wireline setting tool 11 will now be described. The wireline setting tool 11 with the device to be set 193 engaged thereon, as shown in FIG. 1D, is lowered on a wireline to the desired setting depth within the well bore. As shown in FIG. 1D, the device to be set 193 is engaged on the setting tool 11 with the setting sleeve 229 engaging the depending sleeve portion 231 of the setting tool and the end sub 203 of the device to be set engaging the lower extent 195 of the piston portion 111 of the setting tool whereby opposite relative movement of the inner piston portion 111 and the outer sleeve portion 231 of the setting tool serves to set the device 193.

Figure 2A:
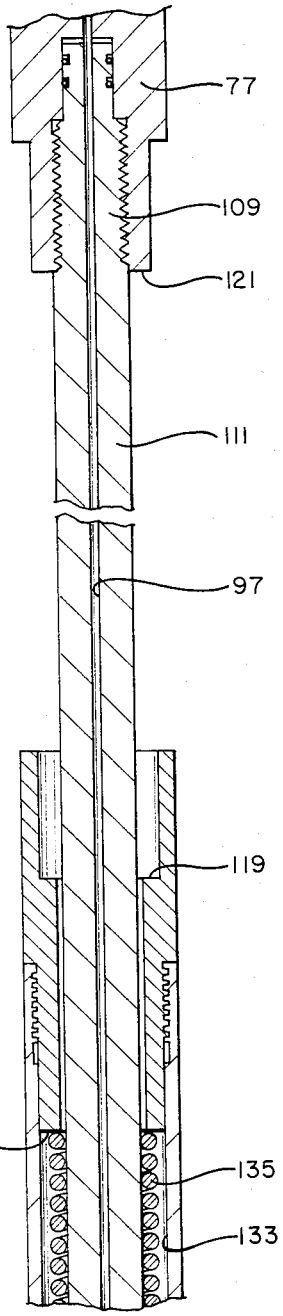
FIG. 2A is a side cross-sectional view of the upper end of the tool showing the tool in the position to be retrieved from the well bore.
Figure 2B:
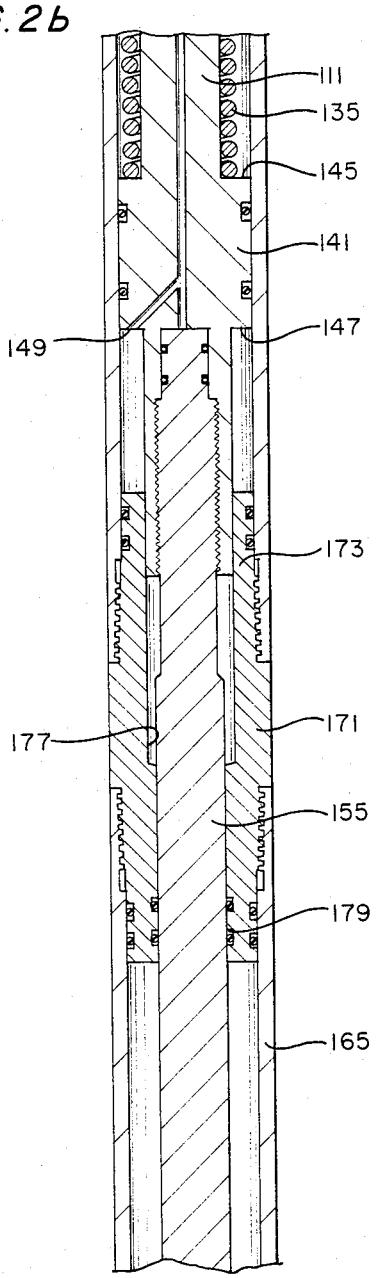
FIG. 2B is a downward continuation of FIG. 2A.

Once the desired setting depth has been reached, the electric motor 19 is actuated by turning on the source of electric power at the well surface which is connected through the wireline (not shown) to the motor 19. Actuation of the motor 19 causes the motor output shaft 21 (FIG. 1A) to be rotated which, in turn, acts through the coupling 27 to drive the hydraulic pump 29. The hydraulic pump 29 draws hydraulic fluid 89 from the surrounding space 93 within the tubular body 13 into a fluid intake (not shown) and forces pressurized hydraulic fluid out the fluid output 65 through the passage 97 in the connecting sub 77 (FIG. 1B). The positive displacement radial piston pump 29 gradually develops a fluid pressure at the output which, in most cases, will range from about 10,000 to 20,000 psi. The gradually increasing hydraulic fluid pressure is communicated by means of end opening 149 of passage 115 to the outer face region 147 of the piston area 141. Fluid pressure acting upon the outer face region 147 causes piston area 141 to move upwardly relative to the spring sleeve 127, thereby causing the tool to separate at the internal shoulder 119 and downwardly extending portion 212 as shown in FIG. 2A. As the piston portion 111 moves upwardly, the coil spring 135 (FIG's. 2A–2B) is compressed between the shoulder 131 and innerface region 145 of the piston area 141.

It can be seen in FIG's. 2A–2C that as the piston portion 111 begins to move upwardly, well fluids are allowed to enter through the bore 133 to act upon the cross-sectional area of the exposed inner face region 145. The effect of the well hydrostatic head acting upon the innerface region 145 is offset, however, by the fact that well fluids are allowed to act upon the lower face region 235 of the lower piston area 161. The exposed cross-sectional area of the lower face region 235 is approximately equal to the exposed cross-sectional area of the inner face region 145 to equalize the effect of the well hydrostatic head upon movement of the piston portion 111 during the setting action of the tool. Bore 133 (FIG. 2A) can be initially filled with oil or any other suitable fluid, as well.

Figure 2C:
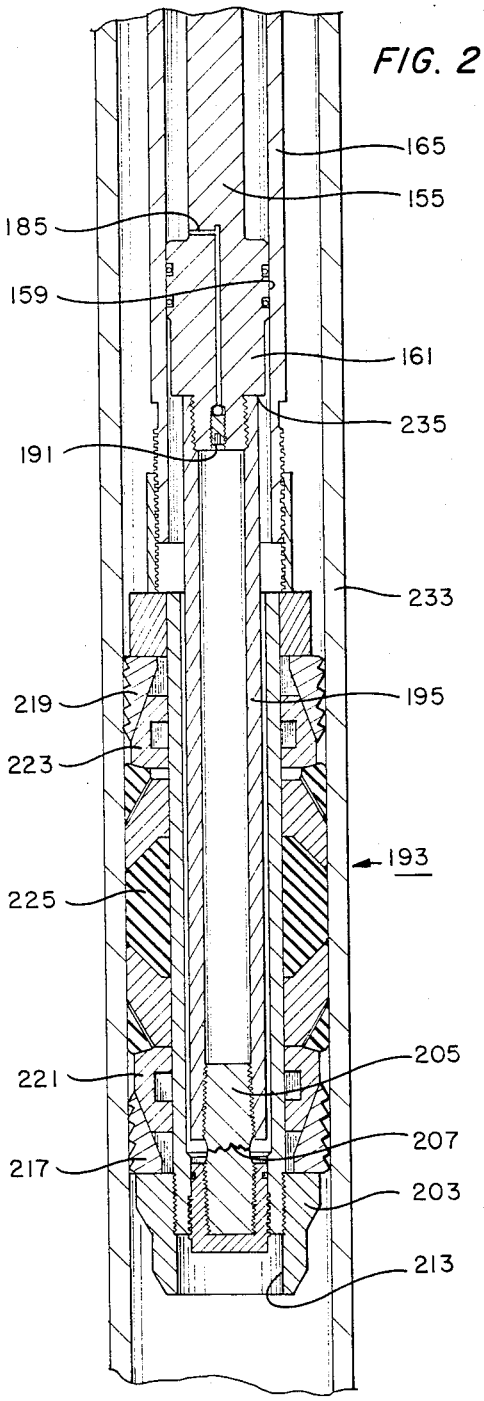
FIG. 2C is a downward continuation of FIG. 2B showing the tool in position to be retrieved from the well bore.

As the piston portion 111 begins to move upwardly from the collapsed, running in position shown in FIG's. 1A–1D to the extended, setting position shown in FIG's. 2A–2C, the end sub 203 forces the gripping slips 217, 219 over the associated expanders 221, 223 to engage the well casing 233 and causes the outward radial expansion of the seal portion 225 to form a seal with the well casing 233. THe increase in hydraulic fluid pressure thus acts on the piston portion 111 of the tool to effect a gradual setting action in the device to be set 193. Once the device 193 is set as shown in FIG. 2C, the continued application of hydraulic fluid pressure through the passageway 97 and end opening 149 exerts a shearing force on the frangible connection 205 eventually causing the connection 205 to shear at the central region 207, as shown in FIG. 2C. Once the frangible connection 205 is sheared, the setting tool can be withdrawn from within the tubular body 215 of the device 193 and the setting tool can be retrieved to the well surface on the wireline. The cross-sectional area of the central region 207 of the frangible connection 205 is selected to provide a predetermined shear force which is suitable for setting the device 193. The shear force required to sever the frangible means 205 is typically greater than about 10,000 psi.

Once the setting tool 11 has been retrieved to the well surface, the plug 103 (FIG. 1B) can be loosened to allow a gradual release of hydraulic fluid pressure from the passageway 97 back to the space 93 surrounding the pump 29. The release of hydraulic pressure through the side passage 99 in connecting sub 77 along with the release of tension in the spring 135 allows the piston portion to be returned to the collapsed, running-in position. The plug 189 in the end opening 191 of lower piston area 161 is provided to allow a release of air pressure in the bore 163 of the setting tool during assembly of the piston portion 111 within the tubular body 13.

An invention has been provided with significant advantages. The hydraulic setting tool of the invention does not require the use of explosive charges which pose safety problems and require frequent cleanup maintenance. By providing a controlled increase in fluid pressure to the inner piston portion of the tool to move the inner piston portion relative to the outer sleeve portion, a gradual setting action can be achieved which is more desirable than the sudden effect of an explosive charge. The use of an electric motor and hydraulic pump provides reliability of operation and does not require frequent maintenance or cleanup. The tool piston portion is pressure balanced to minimize the effect of the well hydrostatic head and is spring biased to return to the collapsed, running-in position once the setting operation has been completed and the device is retrieved to the well surface.

The foregoing disclosure and description of the invention are illustrative and explanatory thereof, and various changes in the method steps as well as in the details of the illustrative apparatus may be made within the scope of the appended claims without departing from the spirit of the invention.

I claim:

1. A setting tool of the type used to set downhole devices in a well bore, comprising:

an elongated tubular body, said body having an outer sleeve portion and an inner piston portion slidably received within said sleeve portion, said inner piston portion and said outer sleeve portion being engagable with said device to be set whereby opposite relative movement of said piston portion and said sleeve portion acts to set said device; and hydraulic pump means carried within said tubular body communicating with said inner piston portion by fluid passage means within said tubular body and isolated from said well annulus for supplying pressurized hydraulic fluid to said inner piston portion of said setting tool to move said inner piston portion relative to said outer sleeve portion and thereby set said downhole device.

2. A wireline setting tool of the type used to set downhole devices in a well bore, comprising:

an elongated tubular body adapted to be supported from a wireline within said well bore said body having an outer sleeve portion and an inner piston portion slidably received within said sleeve portion, said inner piston portion and said outer sleeve portion being engagable with said device to be set whereby opposite relative movement of said piston portion and said sleeve portion acts to set said device;

an electric motor carried within said tubular body and connected through said wireline with a source of electric power at the well surface and said motor having an output shaft;

a hydraulic pump carried within said tubular body having a fluid intake and fluid output said pump being coupled to said output shaft of said electric motor and driven thereby; and fluid passage means communicating said hydraulic pump fluid output with said body inner piston portion for supplying pressurized hydraulic fluid to said inner piston portion to move said inner piston portion relative to said outer sleeve portion and thereby set said downhole device.

3. The wireline setting tool of claim 2, wherein said inner piston portion engages said device to be set by means of a frangible connection, movement of said inner piston portion relative to said outer sleeve member serving to sever said frangible connection at a predetermined shear force to thereby release said setting tool from said set downhole device.

4. The wireline setting tool of claim 3, wherein said hydraulic pump is a positive displacement radial piston pump.

5. The wireline setting tool of claim 4, wherein said inner piston portion has upper and lower piston areas which are exposed to well fluid pressure as said inner piston portion moves relative to said outer sleeve member between a collapsed, running-in position and an extended setting position, to thereby equalize the well forces acting on said piston portion as said downhole device is set.

6. The wireline setting tool of claim 5, wherein said tubular body has an internal shoulder and said piston portion received within said tubular body has a region of reduced external diameter, said tool further comprising a spring located about said piston region of reduced external diameter between a piston area thereof and said tubular body internal shoulder to bias said outer sleeve and said piston portion toward said collapsed, running-in position.

7. The wireline setting tool of claim 6, wherein the fluid pressure at the output of said hydraulic pump is in the range of 10,000–20,000 psi.

8. The wireline setting tool of claim 7, wherein the shear force required to sever said frangible means is greater than 10,000 psi.

9. A method of setting a downhole device in a well bore, comprising the steps of:

engaging said device to be set with a setting tool having an outer sleeve portion and an inner piston portion slidably received within said sleeve portion, said device being engagable with said setting tool whereby opposite relative movement of said inner piston portion and outer sleeve portion acts to set said device;

lowering said setting tool and device to be set on a wireline to the desired setting depth within said well bore; and supplying gradual hydraulic fluid pressure from a hydraulic pump to said inner piston portion of said setting tool through fluid passage means located within said tubular body and isolated from said well annulus to move said inner piston portion relative to said outer sleeve portion of thereby set said downhole device.

10. A method of setting a downhole device in a well bore, comprising the steps of:

engaging said device to be set with a setting tool having an outer sleeve portion and an inner piston portion slidably received within said sleeve portion, said device being engagable with said setting tool whereby opposite relative movement of said inner piston portion and outer sleeve portion acts to set said device;

lowering said setting tool and device to be set on a wireline to the desired setting depth within said well bore;

supplying gradual hydraulic fluid pressure to said inner piston portion of said setting tool to move said inner piston portion relative to said outer sleeve portion to thereby set said downhole device;

supplying additional hydraulic fluid pressure to said inner piston portion to separate said setting tool from said device; and retrieving said setting tool to the well surface.

* * * * *